US007412745B2

(12) United States Patent
Connolly

(10) Patent No.: US 7,412,745 B2
(45) Date of Patent: Aug. 19, 2008

(54) BRUSHLESS WIRE-ROPE CLEANING DEVICE

(76) Inventor: Michael J Connolly, 60-17 54th Ave., Maspeth, NY (US) 11378

( * ) Notice: Subject to any disclaimer, the term of this patent is extended or adjusted under 35 U.S.C. 154(b) by 797 days.

(21) Appl. No.: 10/815,523

(22) Filed: Apr. 1, 2004

(65) Prior Publication Data

US 2005/0217058 A1 Oct. 6, 2005

(51) Int. Cl.
*B08B 11/00* (2006.01)

(52) U.S. Cl. ..... 15/256.6; 15/88; 15/88.1; 187/414; 474/92; 196/494; 196/496; 196/499; 184/15.1

(58) Field of Classification Search ..... 15/256.6, 15/88.1, 236.01, 88, 256.5; 134/9; 187/414; 184/15.1, 16; 474/92; 198/499, 494, 496
See application file for complete search history.

(56) References Cited

U.S. PATENT DOCUMENTS 3,999,240 A * 12/1976 Uchida ..... 15/256.6
4,422,208 A * 12/1983 Rohrbaugh ..... 15/256.6
4,570,285 A * 2/1986 Skelton ..... 15/256.6
5,386,882 A * 2/1995 Friend ..... 184/15.3
5,791,011 A * 8/1998 Richter et al. ..... 15/256.6
6,470,528 B1 * 10/2002 Connolly ..... 15/256.6

FOREIGN PATENT DOCUMENTS

GB 858832 * 1/1961
RU 759441 * 5/1978

* cited by examiner

*Primary Examiner*—Gary K Graham
(74) *Attorney, Agent, or Firm*—Ostrolenk, Faber, Gerb, & Soffen, LLP

(57) ABSTRACT

A brushless wire-rope cleaner having a base plate, two side members arranged on a base plate at a distance from one another, and a cover extending from one side member to the other side member so that the base plate, the side members and the cover form a channel. A cleaning element is slideably arranged in the channel and a tensioning mechanism is arranged to slide the cleaning element through the channel.

17 Claims, 6 Drawing Sheets

FIG.5
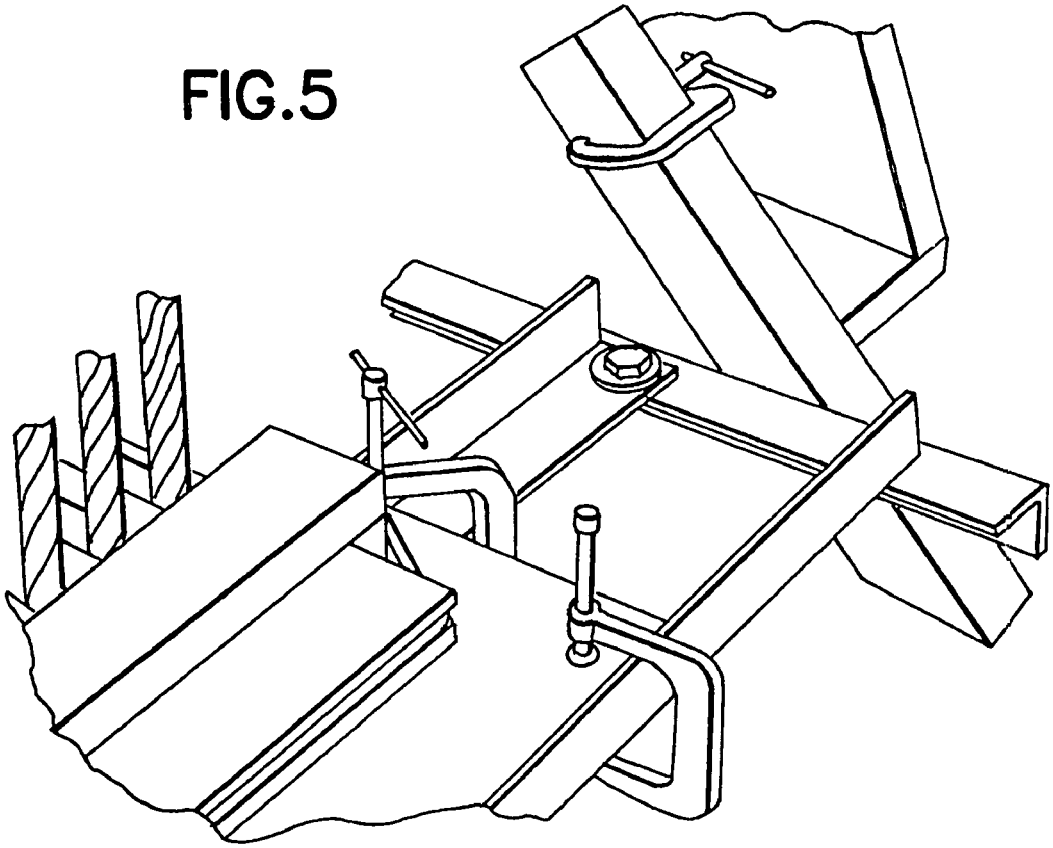
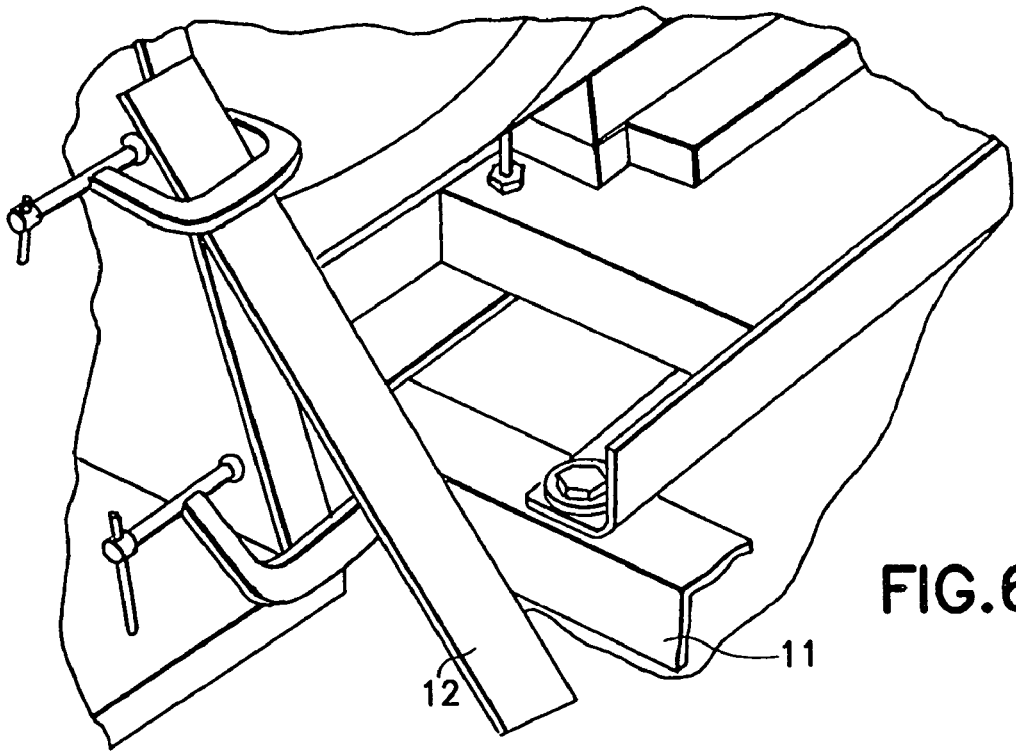
FIG.6

BRUSHLESS WIRE-ROPE CLEANING DEVICE

BACKGROUND OF THE INVENTION

The present invention relates to devices for cleaning wire cables, and more particularly to a brushless cleaning device.

The conventional manner in which elevators are operated is by hoisting and lowering of the elevator car by wire cable. Wire cables are constructed of individual strands of wire that are twisted to form the cables. Typically five to six such cables are required for each elevator car installation, depending upon the load rating of the elevator and the length of the elevator's run.

FIG. 12 is a simplified illustration of a conventional signal elevator installation 10. The cables 100 extend from the elevator car 110, over the hoist machine 130 and offset wheel 120 to the counterweight 140. The offset wheel 120 is required to offset the elevator car 110 from the counterweight 140 such that each will not interfere with the travel of the other. The hoist machine 130 is typically installed on the top or intermediate floor 150 of the building and is supported by legs 135.

As seen FIG. 12, at least one side of the cables separate from the hoist machine 130 substantially perpendicular to the floor 150, while the other side of the cables separate from the machine 130 at an oblique angle. This angle is caused by the above described offset required between the counterweight 140 and the car 110. From the machine 130, the cables 100 pass through two holes 160, 170 in the floor 150 to reach the car 110 and the weight 140 respectively.

The cables 100 require lubrication in order to operate properly. In the course of operation, the cables 100 become caked with contaminants that adhere to the lubricant and to the cables 100 themselves. The contaminants consist essentially of dirt and dust. For safety reasons, the cables 100 must be periodically cleaned to remove the contaminants. Cables have usually been cleaned by hand using rags, lubricant and a wire brush. Often, cleaning was performed while the cables were in operation since halting use of the elevator for manual cleaning of cables could take the elevator out of service for several hours. As the cables typically travel at 1,400 feet/minute, manual cleaning is an inherently dangerous operation.

Various types of cleaning devices are known in the art. For example, U.S. Pat. No. 5,386,882 (the '882 patent) discloses an apparatus for mechanical holding a pair of brushes on either side of the cables. The apparatus of the '882 patent includes a U-shaped holder that is bolted directly to the floor in the area of the holes through which the elevator cables pass.

Another brush-type cleaning apparatus is disclosed in my prior U.S. Pat. No. 6,470,528.

A brushless cleaning device is disclosed in U.S. Pat. No. 5,791,011. In this device, a length of carpet is draped over the cables as they pass over the cable sheave. The carpet services to wipe the cables as they move around the sheave.

The problems associated with brush-type cleaning devices include the potential for damaging the cable surfaces over time, as well as the problem of metal filings collecting on the motor armature and field pieces The main problem with carpet type cleaners is that a relatively long length of carpet is required which once it is contaminated with sludge must be replaced. Due to its length and weight it is cumbersome and difficult to replace the carpet.

SUMMARY OF THE INVENTION

Accordingly, it is an object of the present invention to provide a cleaning device for elevator cables which allows automatic feeding of the cleaning medium. It is a further object of the invention to provide a cleaning device that can be provided as a stand alone system or mounted by brackets to the hoisting mechanism.

Pursuant to these objects, and others which will become apparent hereafter, one aspect of the present invention resides in a brushless wire-rope cleaner having a base plate, two side members arranged on the base plate at a distance from one another and a cover extending from one side member to the other side member so that the base plate, side members and cover form a channel. A cleaning element is slideably arranged within the channel and a tensioning mechanism applies forward pressure to move the cleaning element through the channel.

In another embodiment of the invention, the cleaning element is a block of extruded polystyrene.

The plate has an upwardly facing surface area that is at least equal to the downwardly facing surface area of the cover.

The tensioning mechanism, in one embodiment, includes an elastic band extending transversely across the channel so that the band engages the distal end of the cleaning element producing forward movement of the cleaning element.

In another embodiment, the tensioning mechanism includes a spring arrangement located behind the distal end of the cleaning element so as to apply forward motion of the cleaning element through the channel.

Preferably the ends of the elastic band are attached near or to the side members. This attachment can take place by a peg extending laterally from the side members or mounted vertically to the base plate. The side members can also be provided, in another embodiment of the invention, with slots that extend inwardly from the distal end of the side member so that the elastic band can pass through a portion of the side member to advance the cleaning element further through the channel. The bottom of the slot acts as a stop beyond which the elastic band will no longer apply pressure to the cleaning element.

Noise which could be generated by vibration of the cleaning element as it is pressed against the wire ropes can be attenuated by providing damping materials such as felt strips on the inner faces of the channel.

The cleaning element itself can be made of extruded polystyrene, felt or any other suitable substance.

Other features and advantages of the present invention will become apparent from the following description of the invention which refers to the accompanying drawings.

BRIEF DESCRIPTION OF THE DRAWING(S)

FIG. 5 is a detailed view of one side of the bracket system of FIG. 4;

FIG. 6 is a view showing a second side of the bracket system of FIG. 4;

DETAILED DESCRIPTION OF THE INVENTION

Figure 1:
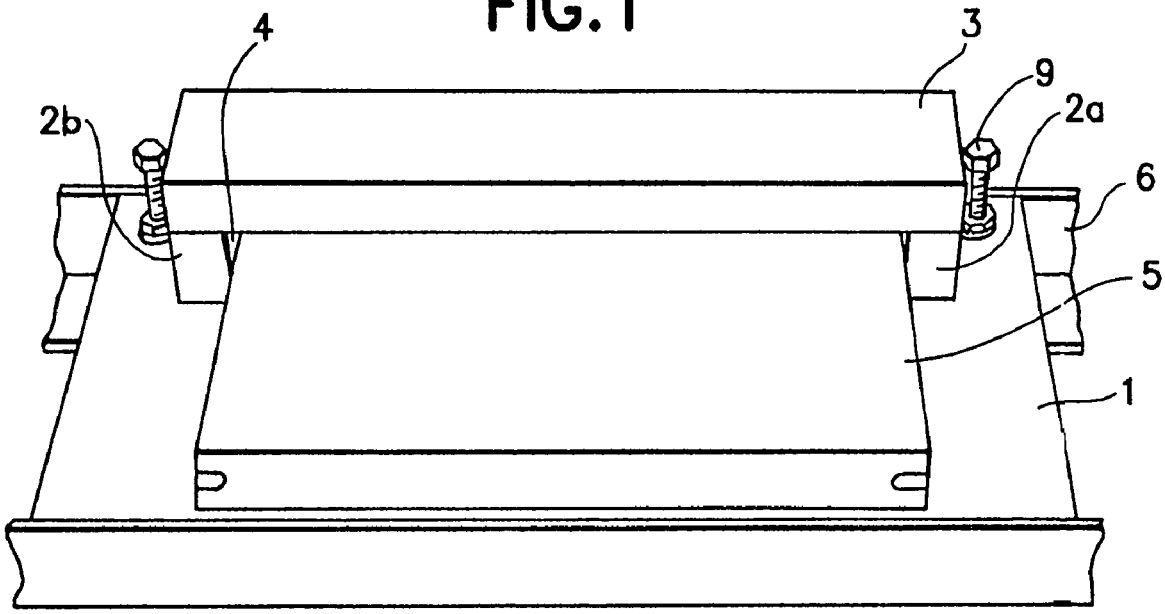
FIG. 1 is a perspective view of the brushless wire-rope cleaner without the elastic band.
Figure 2:
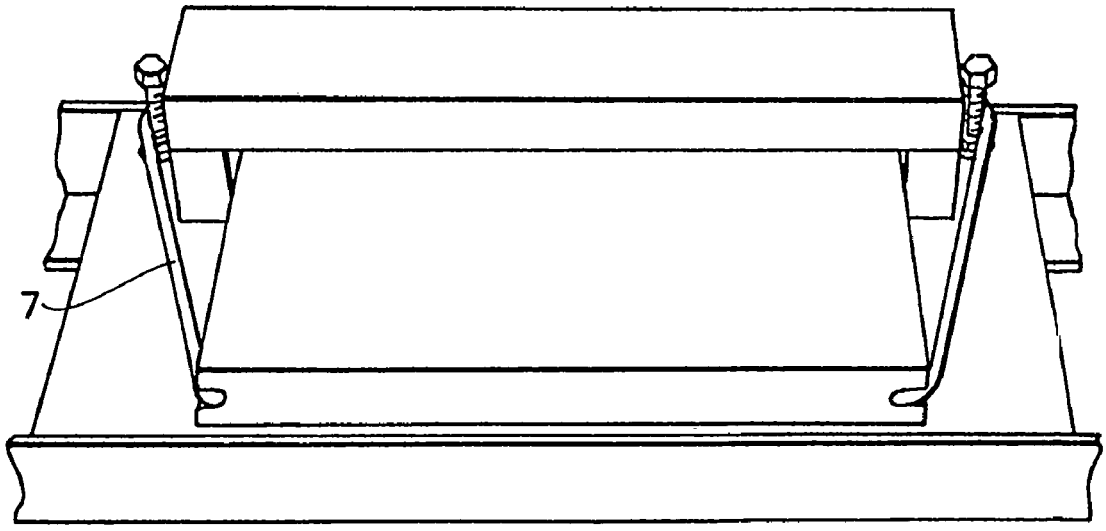
FIG. 2 is a view similar to FIG. 1 including the elastic band.
Figure 3:
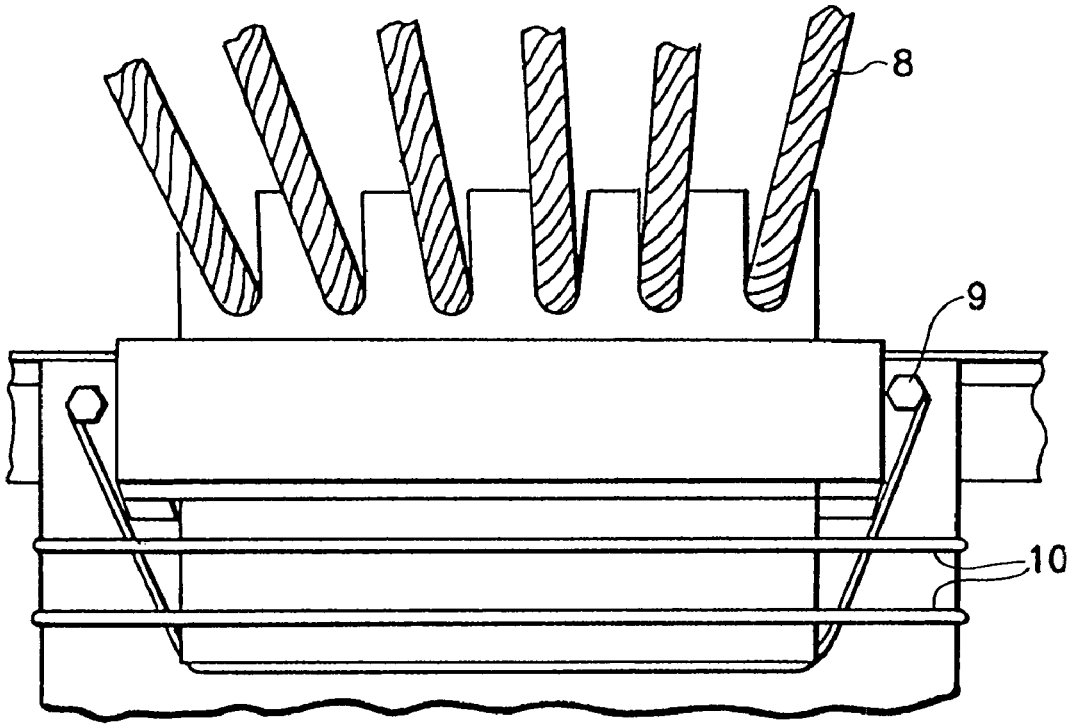
FIG. 3 is a top view of the cleaner of FIG. 1.

FIG. 1 is a perspective view of the first embodiment of the inventive brushless wire rope cleaner in a position immediately prior to use. As can be seen in this drawing, the basic structure of the device is made up of a base plate 1 which has a large sliding surface area, two side walls 2*a*, 2*b* attached at a distance to one another to the base plate 1, and a cover member 3 mounted to the side pieces 2*a*, 2*b* so as to form a channel 4. It is understood that although the channel in the illustrated embodiment is rectangular, it can have any suitable geometric configuration. A cleaning element 5 is slideably arranged in the channel 4. Although the cleaning element 5 in the illustrated embodiment is an extruded polystyrene block, it can be any suitable material for wiping the rope clean, for example, felt or canvas.

The assembly is mounted on a frame 6 that can either be free standing or attached to components of the elevator system to which the cables belong. A tensioning member 7 is provided so as to force the cleaning element 5 through the channel. In its simplest form the tensioning member is an elastic band that passes around the distal end of the cleaning element 5 and is attached in a region of both side pieces 2*a*, 2*b*. The elastic member 7 can be attached at each end to a mounting post 9 that extends upwardly from the base plate 1. The tension of the elastic member 7 causes the polystyrene block 5 to be pressed against the elevator cables 8. When the elevator cables 8 are not moving, the cleaning block 8 merely remains in a static position held by the elastic member 7. Once the elevator operates and the cables 8 begin to move, the friction between the cables 8 and the polystyrene block 5 causes the cables 8 to wear away at the polystyrene block 5 due to friction. Elastic member 7 maintains pressure on the polystyrene block 5 so that it stays in contact with cables 8 and thereby wipes or cleans the cables. The block 5 continues to be pushed through the channel 4 until it reaches a stop or passes completely into the channel and is not longer under sufficient tension by the elastic member 7. At this point, it is necessary to replace the polystyrene block 5 with a new block.

Additional elastic members 10 can be provided so as to pass over the upper surface of the polystyrene block 5 to prevent vibration of the block 5 during operation.

Figure 4:
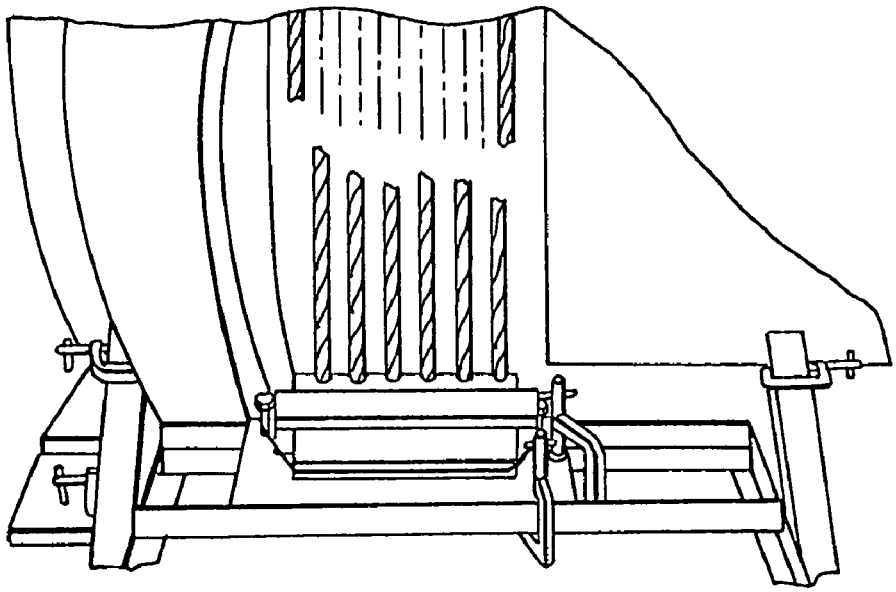
FIG. 4 is a perspective view showing the cleaner mounted on a bracket system.
Figure 7:
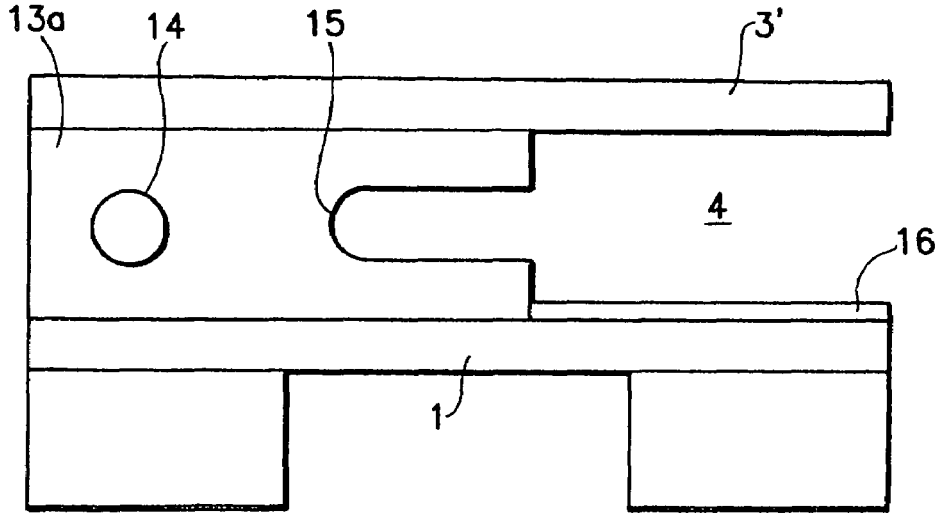
FIG. 7 is a side view of a second embodiment of the cleaner.
Figure 8:
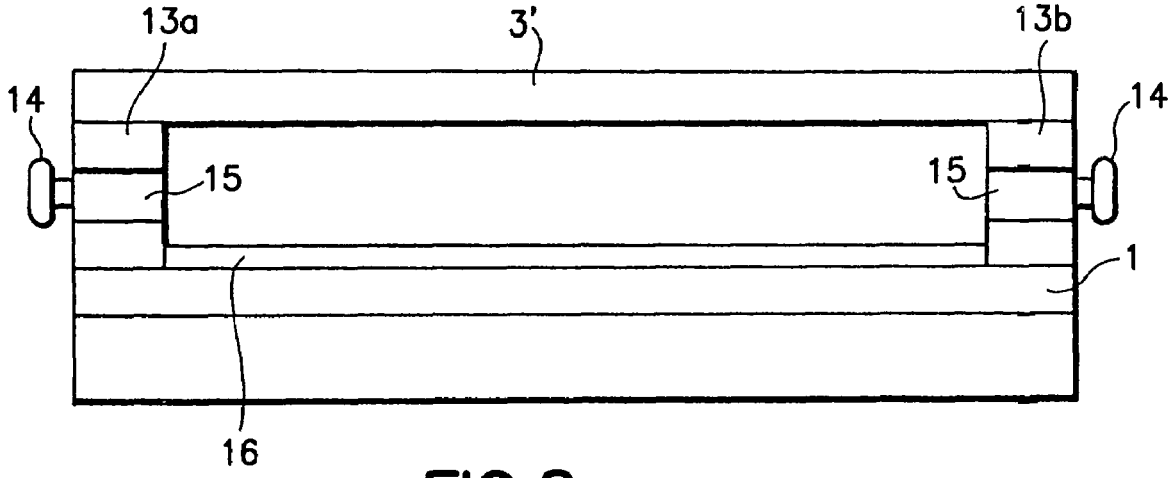
FIG. 8 is a rear view of the embodiment of FIG. 7.
Figure 9:
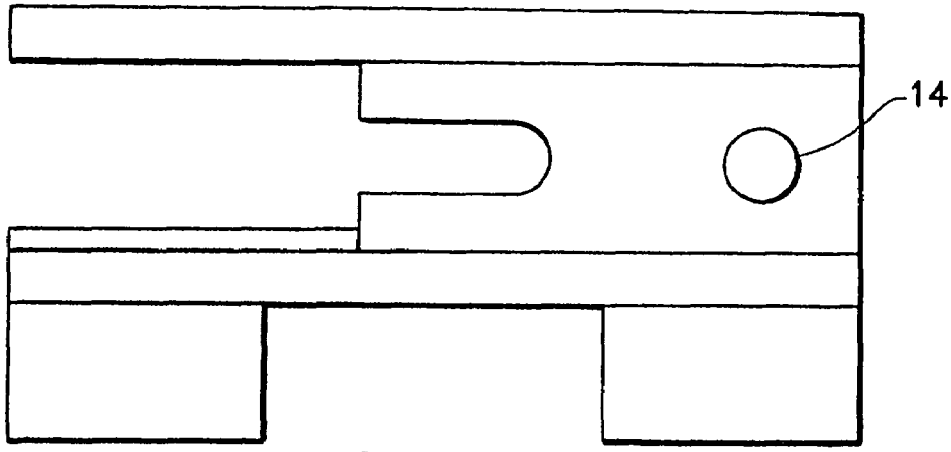
FIG. 9 is an opposite side view of the embodiment of FIG. 7.
Figure 10:
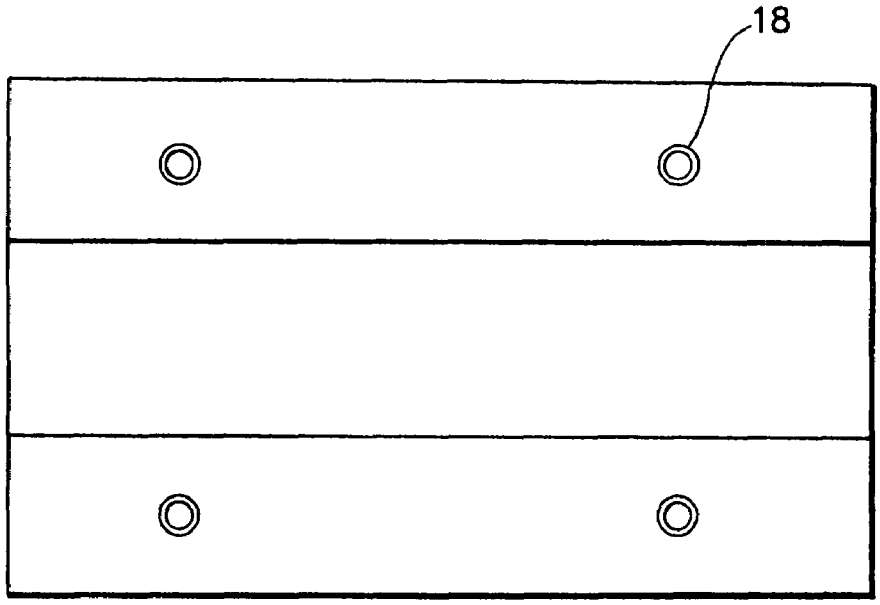
FIG. 10 is a bottom view of the embodiment of FIG. 7.

FIGS. 4-6 show one embodiment of the frame 6 for supporting the brushless wire rope cleaner assembly. In the illustrated embodiments, the frame 6 is attached to a support member of the elevator cable rope drum or sheave. However, those skilled in the art will readily appreciate that the frame 6 can be constructed so as to be free standing without mounting to the elevator equipment itself. The illustrated frame 6 is essentially a platform made up of angle members that are connected to form a lateral support 11 to which the base plate 1 is mounted. Leg members 12 are provided at each end of the lateral support 11. The leg members 12 are then fastenable to a part of the elevator machinery so that the channel 4 faces the elevator ropes 8.

Another embodiment of the invention is shown in FIGS. 7-10. This embodiment is shown without the frame for supporting the cleaning device at the elevator ropes. In this embodiment, the cover 3' is the same size as the base plate 1. The side pieces 13*a*, 13*b* have a post 14 extending laterally therefrom. The post is used for attaching the end of the elastic band 7. The side pieces 13*a*, 13*b* also have a slot 15 that extends toward the rear of the channel 4. The slot 15 serves to allow the elastic band 6 to pass further in the direction toward the ropes as the cleaning element 5 is pushed through channel 4. The base of the slot 15 acts as a stop and prevents the elastic member 6 from pressing further against the cleaning element 5. The bottom of the base plate 1 is provided with threaded inserts 18 for mounting the base plate 1 to the frame. Threaded inserts are only one possibility of mounting the base plate 1 to the frame. A mounting can of course take any number of other configurations which are within the knowledge of those skilled in the art. In order to reduce vibration of the cleaning block in the channel 4, felt strips 16 are arranged throughout the channel to assist in attenuating vibration.

Figure 11:
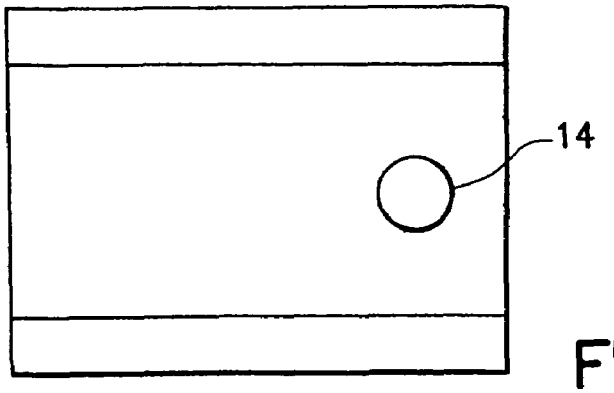
FIG. 11 is a side view of a third embodiment of the invention.
Figure 12:
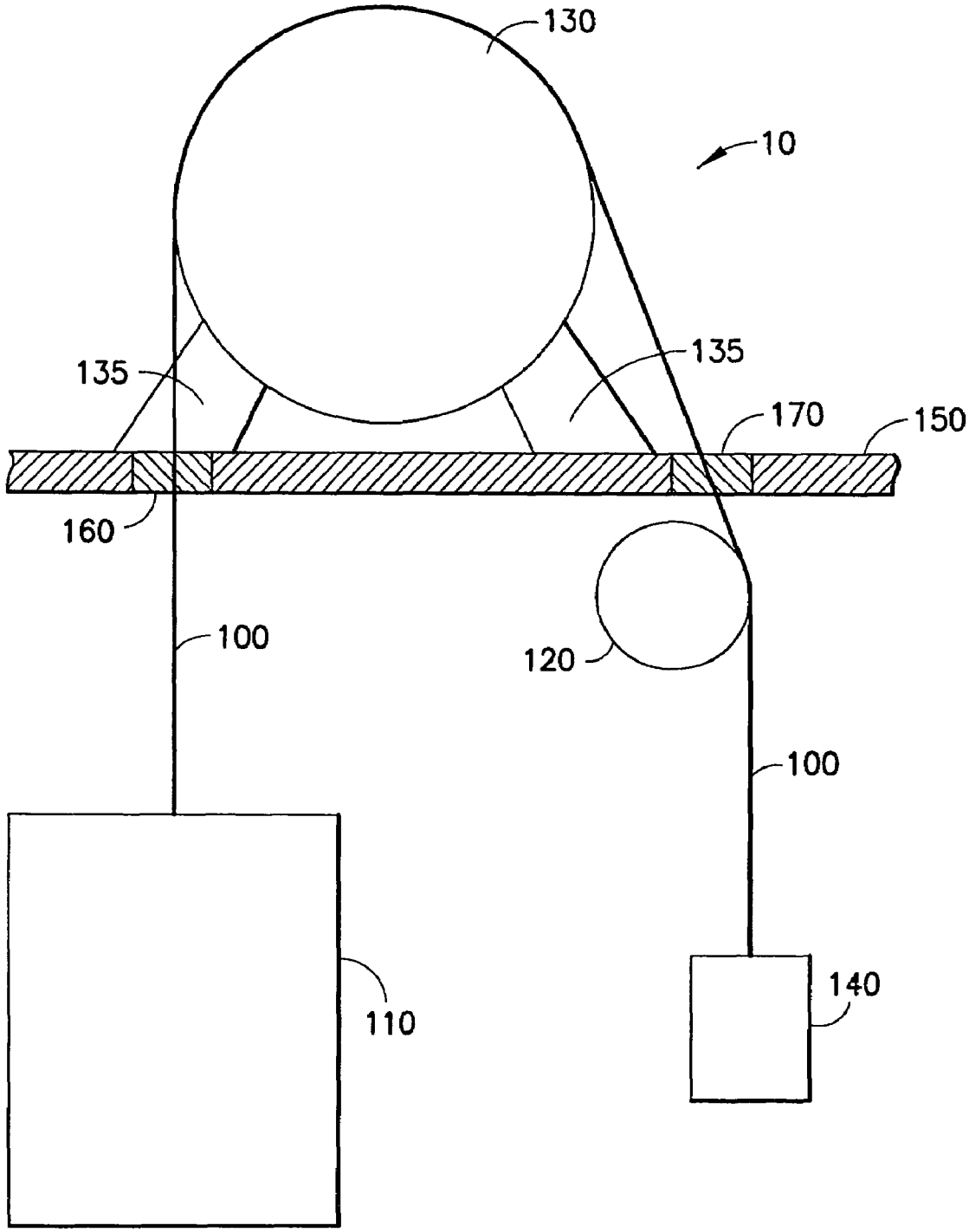
FIG. 12 PRIOR ART
FIG. 12 illustrates a typical prior art elevator assembly construction.

FIG. 11 shows yet another embodiment of the invention in which the base plate and the cover are both very short and the side wall has a post 14, but does not have a slot. In this embodiment, the end of the side piece itself forms the stop beyond which the elastic member can no longer push the cleaning block.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A brushless wire rope cleaner, comprising:

a base plate;

two side members arranged on the base plate at a distance from one another;

a cover extending from one side member to the other side member so that the base plate, the side members and the cover form a channel;

a cleaning element slideably arranged in and slideable through the channel, the cleaning element having an externally exposed surface to be applied against a wire rope to be cleaned; and a tensioning mechanism operatively arranged to slide the cleaning element through the channel to maintain the externally exposed surface against the wire rope, the tensioning mechanism including an elastic band extending across an inlet of the channel, with the band engaging the distal end of the cleaning element to advance the cleaning element through the channel, the elastic band comprising two ends, with each end of the elastic band respectively attached to one of the side members.

2. The brushless cleaner according to claim 1, wherein the cleaning element is a block of extruded polystyrene.

3. The brushless cleaner according to claim 1, wherein the base plate has an upwardly facing surface area of a different size than a downwardly facing surface area of the cover.

4. The brushless cleaner according to claim 1, wherein the base plate has an upwardly facing surface area substantially equal to a downwardly facing surface area of the cover.

5. The brushless cleaner according to claim 1, wherein the tensioning mechanism includes a spring arrangement located behind the distal end of the cleaning element so as to apply a force on the cleaning element to slide it through the channel.

6. The brushless cleaner according to claim 1, wherein a respective mounting peg is attached to each side member, the ends of the elastic band being attached to the mounting pegs.

7. The brushless cleaner according to claim 1, wherein a respective mounting peg is attached to the base plate adjacent each of the side members, the elastic band has two ends with the ends of the elastic band being attached to the mounting pegs.

8. The brushless cleaner according to claim 1, and further comprising a frame on which the base plate is mounted.

9. The brushless cleaner according to claim 8, wherein the frame includes a platform to which the base plate is mounted and leg members arranged at opposite ends of the platform.

10. The brushless cleaner according to claim 1, wherein the elastic band is looped around attachment on the side members.

11. The brushless cleaner according to claim 10, where a respective mounting peg is attached to each side member.

12. The brushless cleaner according to claim 1, wherein a respective mounting peg is attached to the base plate adjacent to each of the side members.

13. A brushless wire rope cleaner, comprising:

a base plate;

two side members arranged on the base plate at a distance from one another;

a cover extending from one side member to the other side member so that the base plate, the side members and the cover form a channel;

a cleaning element slideably arranged in the channel; and a tensioning mechanism operatively arranged to slide the cleaning element through the channel, wherein the tensioning mechanism includes an elastic band extending across an inlet of the channel so that the band engages the distal end of the cleaning element and thereby advances the cleaning element through the channel, wherein the side members each have a slot that extends from the distal end of the side member so that the elastic band can pass through a portion of the side members to push the distal end of the cleaning element past the distal end of the side members.

14. The brushless cleaner according to claim 13, wherein the slots have a bottom which forms a stop for the elastic band beyond which the cleaning element is not pushed.

15. A brushless wire rope cleaner, comprising:

a base plate;

two side members arranged on the base plate at a distance from one another;

a cover extending from one side member to the other side member so that the base plate, the side members and the cover form a channel;

a cleaning element slideably arranged in the channel; and a tensioning mechanism operatively arranged to slide the cleaning element through the channel, and further comprising vibration damping members mounted on inner surfaces of the channel.

16. The brushless cleaner according to claim 15, wherein the damping members are felt strips.

17. A brushless wire rope cleaner, comprising:

a base plate;

two side members arranged on the base plate at a distance from one another;

a cover extending from one side member to the other side member so that the base plate, the side members and the cover form a channel;

a cleaning element slideably arranged in the channel; and a tensioning mechanism operatively arranged to slide the cleaning element through the channel and further comprising a frame on which the base plate is mounted, wherein the frame includes a platform to which the base plate is mounted and leg members arranged at opposite ends of the platform, wherein the base plate is bolted to the platform.

* * * * *